US007452497B2

(12) United States Patent
Shibata et al.

(10) Patent No.: US 7,452,497 B2
(45) Date of Patent: Nov. 18, 2008

(54) FURNACE SIDEWALL STRUCTURE OF ROTARY HEARTH FURNACE

(75) Inventors: Tomoaki Shibata, Kitakyushu (JP); Shinji Shima, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 606 days.

(21) Appl. No.: 10/516,177

(22) PCT Filed: May 29, 2003

(86) PCT No.: PCT/JP03/06742

§ 371 (c)(1),
(2), (4) Date: Nov. 30, 2004

(87) PCT Pub. No.: WO03/102249

PCT Pub. Date: Dec. 11, 2003

(65) Prior Publication Data

US 2005/0252340 A1 Nov. 17, 2005

(30) Foreign Application Priority Data

May 31, 2002 (JP) ..... 2002-159183

(51) Int. Cl.
*C21B 7/16* (2006.01)

(52) U.S. Cl. ..... 266/178; 266/283; 75/474

(58) Field of Classification Search ..... 266/171, 266/178, 283; 432/138; 75/474
See application file for complete search history.

(56) References Cited

U.S. PATENT DOCUMENTS

| | | | | |
|---|---|---|---|---|
| 3,443,931 | A | 5/1969 | Ahrendt et al. | |
| 3,743,475 | A | 7/1973 | Scarbrough et al. | |
| 5,019,689 | A * | 5/1991 | Bollier et al. | 432/138 |
| 5,060,913 | A | 10/1991 | Reid | |

FOREIGN PATENT DOCUMENTS

| | | |
|---|---|---|
| BE | 878 635 | 3/1980 |
| DE | 3 200 C | 4/1878 |
| GB | 3840 | 0/1877 |
| JP | 2002-310564 | 10/2002 |

* cited by examiner

*Primary Examiner*—Scott Kastler
(74) *Attorney, Agent, or Firm*—Birch, Stewart, Kolasch & Birch, LLP

(57) ABSTRACT

A furnace sidewall structure of a rotary hearth furnace for making direct reduced iron which is agglomerated iron ore or waste iron oxide containing a reducing agent on a rotary hearth by heating or for heating at least one steel piece, wherein the rotary hearth furnace includes an outer furnace sidewall and an inner furnace sidewall, wherein at least one of the outer furnace sidewall and the inner furnace sidewall is polygonal. The furnace sidewall structure can be prepared with lower manufacturing costs relative to conventional circular profile rotary hearth furnace with respect to the furnace sidewall. The production thereof is easy with respect to manufacturing and with respect to the fact that the dimensional accuracy of the manufactured furnace sidewall can be easily adjusted. Also, there is associated a shorter installation/construction work period and a reduction in the installation/construction cost.

18 Claims, 5 Drawing Sheets

FURNACE SIDEWALL STRUCTURE OF ROTARY HEARTH FURNACE

The present application claims priority to Japanese Application 2002-159183, filed in Japan on May 31, 2002 and which is herein incorporated by reference in its entirety.

TECHNICAL FIELD

The present invention relates to a rotary hearth furnace, which is mainly used for making direct reduced iron (hereinafter "DRI") from iron ore or waste iron oxide, or heating at least one steel piece. More precisely the present invention relates to a furnace sidewall structure for a rotary hearth furnace.

BACKGROUND TECHNOLOGY

A rotary hearth furnace is mainly used in making DRI from compacts (briquette or pellet), which is composed of powder iron ore or waste iron oxide and carbonaceous material as the reducing agent, wherein the compacts are placed on a rotating hearth and are reduced in a high-temperature atmosphere to thereby make a reduced iron. The rotary hearth furnace may also be used for heating a steel piece, such as a slab, billet, ingot or coil. Normally, such rotary hearth furnaces are formed with an outer furnace sidewall and an inner furnace sidewall wherein each of the sidewalls is formed of arcuately bent steel sidewall plates in a circular form as shown in FIG. 2.

FIG. 1 is a sectional view of a rotary hearth furnace. FIG. 1 shows an example of a rotary hearth furnace for making DRI, where briquettes 4, which may be formed of a mixture of powder iron ore or waste iron oxide and carbonaceous material as the reducing agent, is charged onto a rotary hearth 1 supported by the hearth wheel 7 and is reduced with heat by a burner 6 installed on a furnace sidewall 2 and is rotationally transported.

FIG. 2 illustrates a structure of a conventional circular profile rotary hearth furnace. In FIG. 2, an outer furnace sidewall 2 and an inner furnace sidewall 8 are each constructed to form circles by joining the blocks (sidewall plates) of slightly curved steel plates to each other. It is, however, hard to bend 3.2-9 mm thick steel sidewall plates to form the circular profile of the furnace sidewall even when using a bending machine (bender). Also, it is difficult to maintain the slightly curved form. This is because the steel plate becomes warped after being disengaged from the bender. Furthermore, the bent steel plate can be deformed by its own weight while being placed on the floor or during transportation, so adjustments and corrections to the bend are often needed.

FIG. 5 is a diagram showing a furnace sidewall of a conventional circular profile rotary hearth furnace. In FIG. 5, the furnace sidewall is constituted with a sidewall steel plate, a backstay, a reinforcing member (not shown in FIG. 5) and a refractory wall. The backstay secures the sidewall plate, and the reinforcing member is secured on the circumference of the sidewall and runs along the curve of the sidewall between the side poles. It is secured on one side by bolting and on the other side by welding as shown in FIG. 5. The reinforcing member can be H-section steel, channel steel or angle steel. The bending of the reinforcing member increases the manufacturing costs. When the curvature of the reinforcing member is different from the curvature of the sidewall plate, the dimensional accuracy of the sidewall plate will be degraded, resulting in added manufacturing costs.

At the installation/construction of the rotary hearth furnace, the adjustments required to be made to compensate for the manufacturing errors in the sidewall plate result in an increase in the time required for installation and an increase in installation costs. When the manufacturing error of the sidewall plate is rather large, this further increases the adjustment work, and an accurate circular furnace profile is never obtained. Furthermore, refractory/brickwork is also required to be adjusted to compensate for errors in the dimensions.

To prepare a castable refractory along the slightly curved sidewall plate, a frame needs to be set up on the sidewall plate. This frame is intricate and has to have a curved shape matching the sidewall plates of the furnace, and as such, raises the costs associated with manufacturing a furnace. Making a curved frame for an accurate refractory wall is not easy, and if the shape of the furnace sidewall plate or the installation is not accurate, the resulting refractory wall is non-uniform in thickness. In the thinner portions of the refractory wall, there is less heat insulation, which increases heat loss from the wall.

An object of the invention is to overcome the aforementioned problems and to provide a furnace sidewall structure of a rotary hearth furnace, which can reduce the manufacturing costs due to the ease in its manufacture and the ease in adjustments to make accurate dimensions of the furnace sidewall, thereby shortening the installation/construction work period and reducing the costs.

SUMMARY OF THE INVENTION

According to studies by the present inventors, the problems described above appear to be caused by slight bending of the thin and wide plates (e.g., 3.2 mm-9 mm in thickness and 1 m-3 m in width of a plain steel plate or a panel such as a panel containing at least one water cooling pipe or the like). To reduce the likelihood of this unwanted bending, the inventors came up with the idea that a plurality of flat sidewall plates, instead of slightly curved sidewall plates, are to be joined so that a plan sectional view of the furnace sidewall sidewall can be approximately circular form. This construct results in a higher accuracy in the shape of the sidewall plates, a reduction in the shop manufacturing work, and a reduction in the installation/construction work period and costs are expected.

An embodiment of the present invention is a furnace sidewall of a rotary hearth furnace for making DRI, which is composed of powder iron ore or waste iron oxide and carbonaceous material as the reducing agent, and heating at least one steel piece, wherein the furnace sidewall comprises: an outer sidewall and an inner furnace sidewall; wherein at least one of the outer furnace sidewall and the inner furnace sidewall is polygonal in form.

In another embodiment, the outer furnace sidewall is polygonal in form and the inner furnace sidewall is circular in form.

In yet another embodiment, the polygonal furnace sidewall includes a refractory wall, wherein the refractory wall is in contact with flat inner surfaces of sidewall plates.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
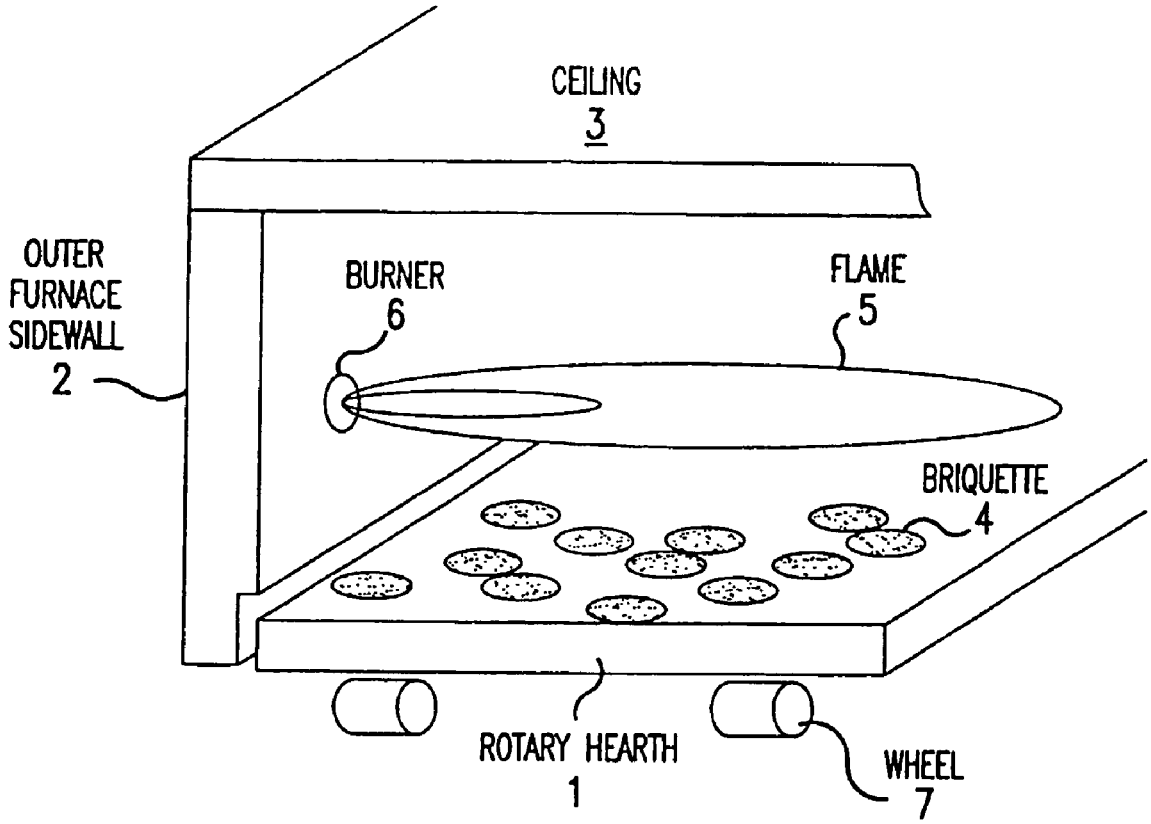
FIG.1 PRIOR ART
FIG. 1 is a sectional view of a prior art rotary hearth furnace.
Figure 2:
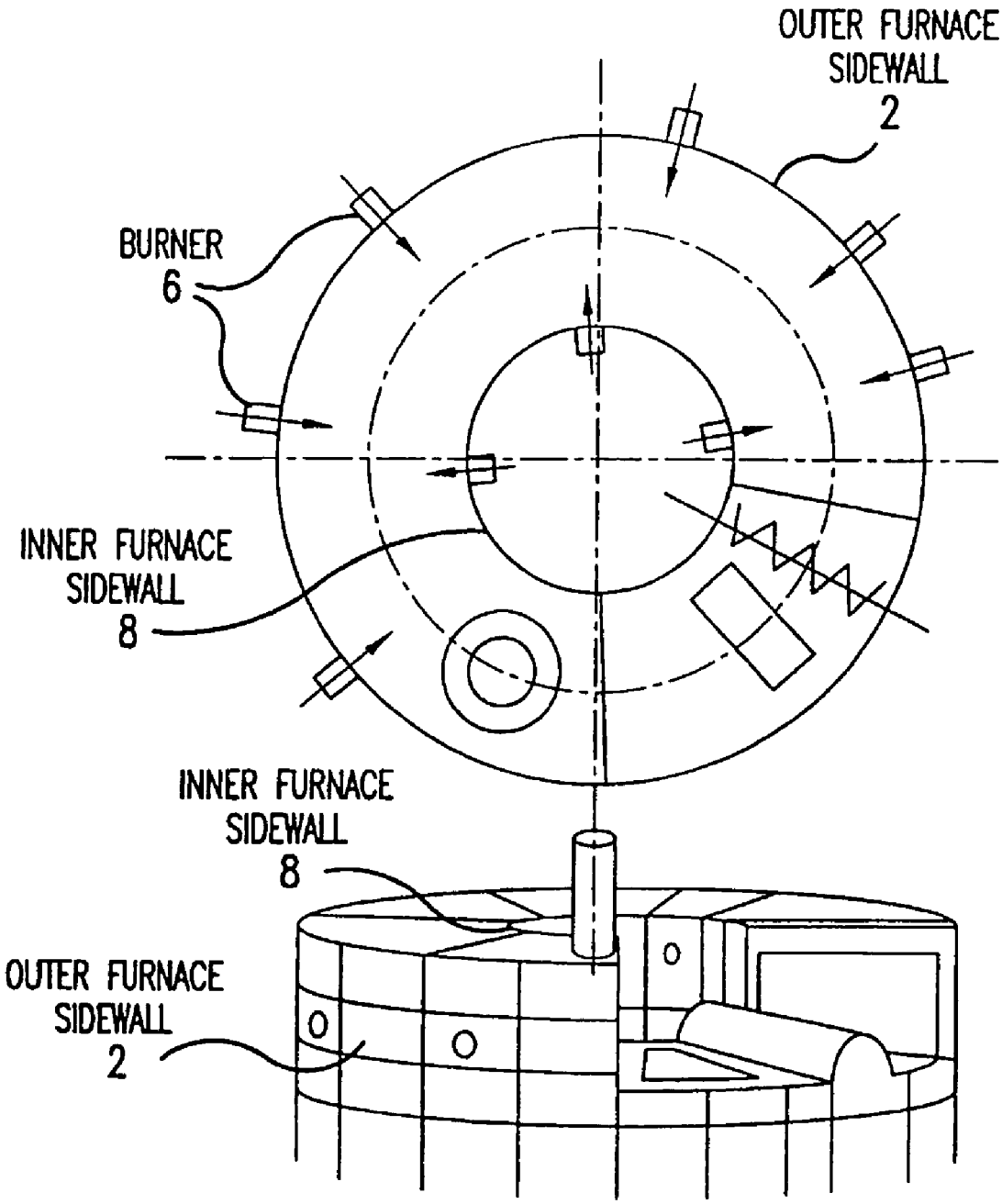
FIG.2 PRIOR ART
FIG. 2 illustrates a structure of a prior art rotary hearth furnace.
Figure 3:
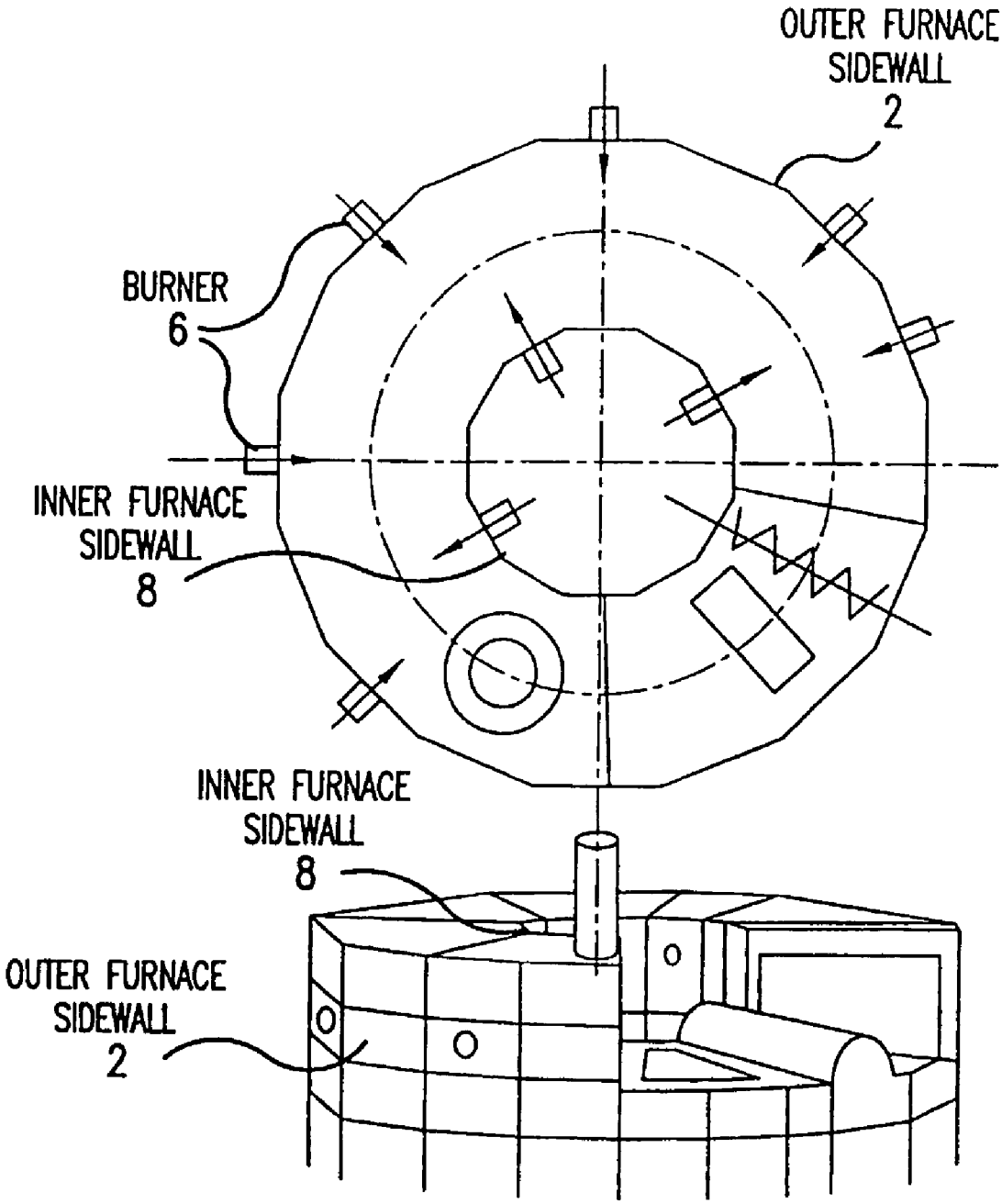
FIG. 3 illustrates a structure of rotary hearth furnace of the invention.
Figure 4A:
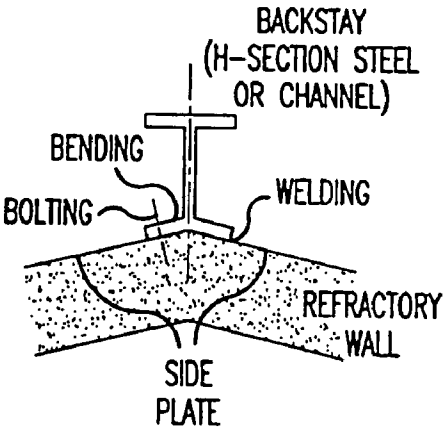
FIG. 4 illustrates furnace sidewall structures of rotary hearth furnace of the invention.
Figure 4B:
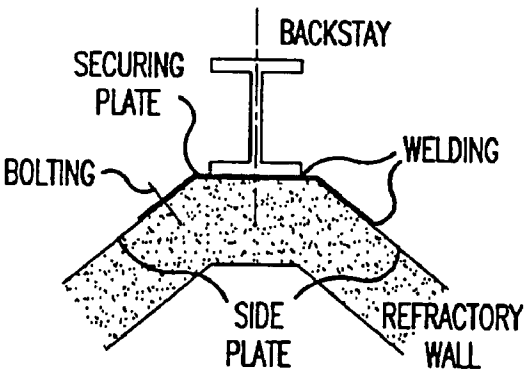
Figure 4C:
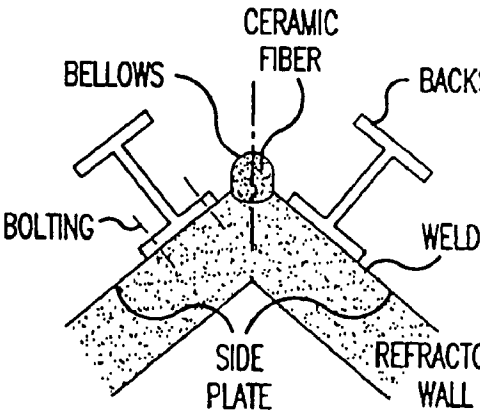
Figure 4D:
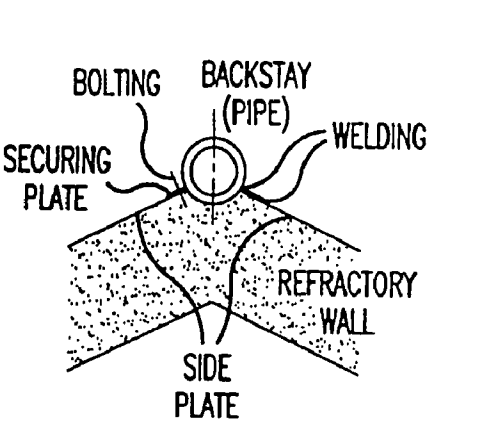
Figure 4E:
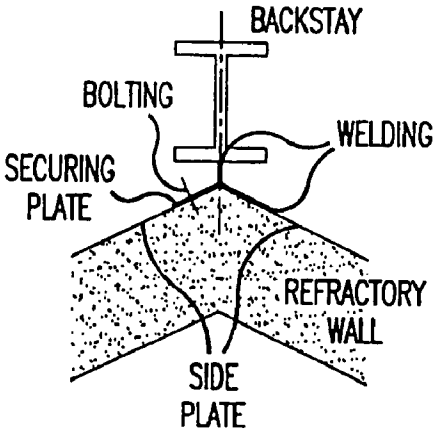
Figure 4F:
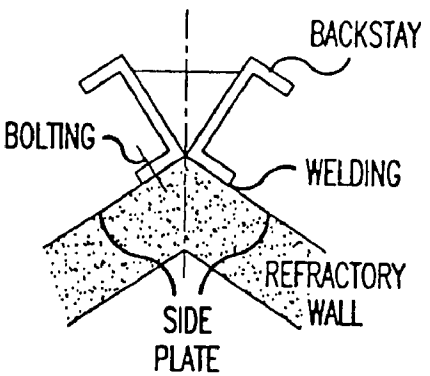
Figure 5:
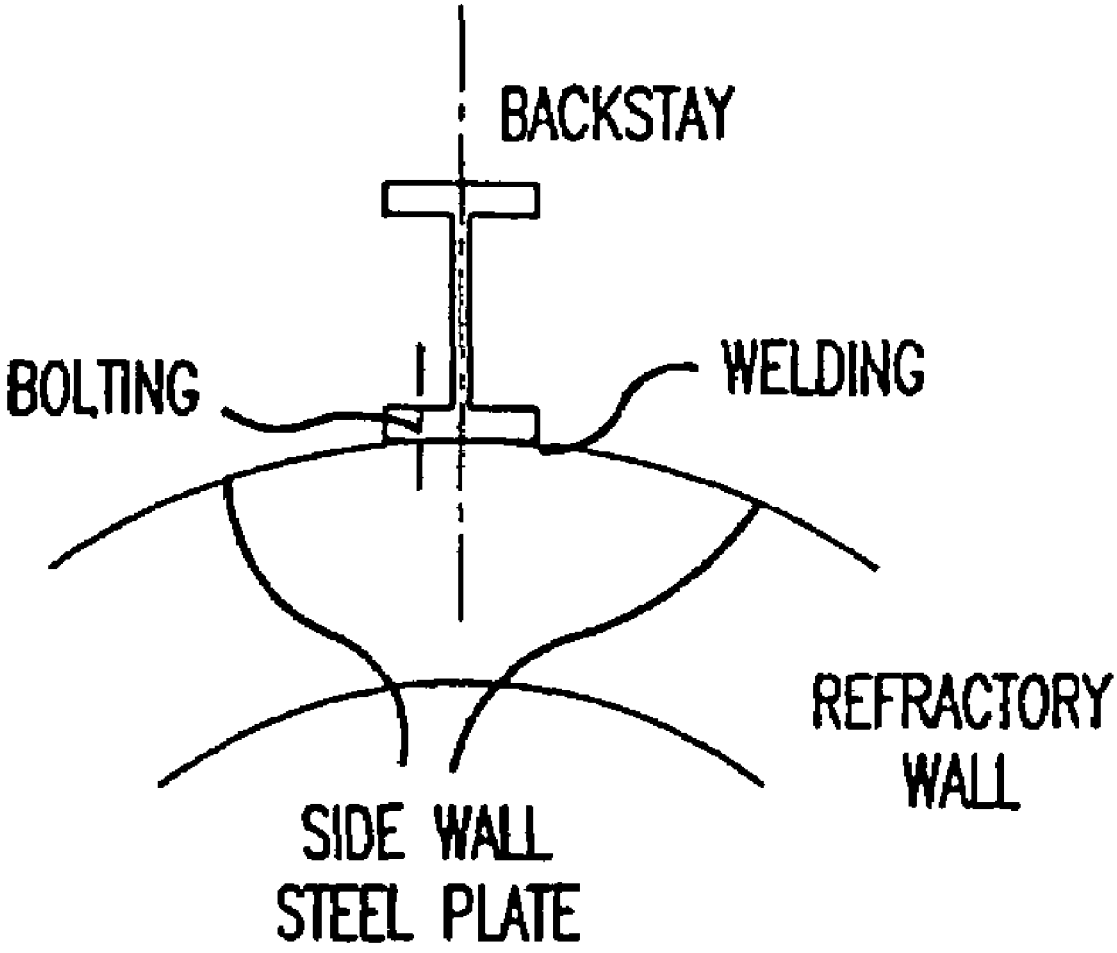
FIG.5 PRIOR ART
FIG. 5 is a diagram showing a backstay of rotary hearth furnace.

FIG. 3 illustrates a structure of a rotary hearth furnace of the invention. An outer furnace sidewall 2 and an inner furnace sidewall 8 are each formed by joining flat steel plates, and the resulting shape is a polygon form. In FIG. 3, the outer furnace sidewall is a hexadecagon and the inner furnace sidewall is a dodecagon; however, it is envisioned that a polygon with at least six flat sidewalls can be applied to form the shape of the furnace, and a furnace of which only one of the inner sidewall and outer sidewall is polygonal form can be adopted. The present invention also encompasses the case wherein at least one of the outer surface sidewall or the inner furnace sidewall includes a flat portion therein. Thus, in this embodiment, the sidewalls can be substantially circular but at least one flat portion (e.g. at least one plate) is included.

For example, in the case where the diameter of outer furnace sidewall is 20 m, the diameter of inner furnace sidewall can be about 15 m. This allows for sufficient space between the outer and inner furnace sidewalls so both can have a polygonal form. However if the diameter of the outer sidewall is 10 m, the diameter of the inner sidewall becomes about 4 m. Therefore, in these smaller furnaces, it is preferable to form a polygonal outer sidewall and a circular inner sidewall.

In an embodiment of the invention, a flat steel plate is directly used in forming the furnace sidewall. This eliminates bending of the sidewall plate with a bender. Thus, the manufacturing and adjustment workload is considerably lowered. During installation/construction at the site, the furnace sidewall blocks can be joined by welding the flat sidewall plates, thereby eliminating fine adjustment work during installation, which has been required for the conventional circular profile rotary hearth furnace construction. Consequently the polygonal formed rotary hearth furnace can be built with less installation time and costs relative to that required for conventional circular profile rotary hearth furnace.

Thus, adopting a flat sidewall panel structure for the sidewall plates of the inner furnace sidewall and/or the outer furnace sidewall of the rotary hearth furnace can reduce the manufacturing cost of the furnace sidewall by simplifying the manufacturing process, that is, by skipping the steps of bending of sidewall plates. Also, an advantage to the accuracy of the inventive manufacturing step is a reduction in the line installation/construction work at the site, which leads to reduced construction work periods and reduced overall costs of construction. Furthermore, when adjustments are needed in the refractory and insulating brick along the inner surface of the flat sidewall panels, the adjustment of the joints between the bricks by joint mortar can be reduced.

As for the frame for casting of castable refractory along the inner surface of the polygon, the shape of the frame is very simple. This makes it easy to set up and adjust the frame at the installation/construction site, which leads to a reduction of the manufacturing cost of the casting frame, a reduction in the work needed for fixing frame and an improvement in the dimensional accuracy of the refractory wall.

As for the method for joining the flat panels to make a polygonal formed furnace sidewall, a narrow width plate (e.g., about 300-600 mm in width) which has been bent by a press can be welded to a backstay, or a flat plate can be secured to a bent flange portion of a backstay, which makes it possible to manufacture the polygonal sidewall with good accuracy and reasonable cost.

FIG. 4 illustrates furnace sidewall structures of a rotary hearth furnace of the invention. The furnace sidewall includes a sidewall steel plate and a refractory wall, which is supported by a section steel backstay or the like. FIG. 4(*a*) shows a structure wherein H-section steel (or bolted two channel steel to make an H-section) is used as a backstay. The flange of the backstay is bent to match the shape of a corner portion of a sidewall plate and the sidewall plate is joined to the flange by bolting and/or welding. FIG. 4(*b*) shows a structure wherein a backstay is joined to a securing plate, which is preferably about 300-600 mm width, by welding. The securing plate is formed with a press to make its shape match the shape of corner portion of the sidewall plate and is joined to the sidewall plate by bolting or welding. FIG. 4(*c*) shows a structure wherein one sidewall plate is joined to another sidewall plate at the corner portion via expanding/contracting bellows. The corner portion is filled with a ceramic fiber and sectional steels are used as the backstay, and are bolted onto the sidewall plate at both sides of the corner portion.

FIG. 4(*d*) shows a structure wherein a pipe used as a backstay is joined to a securing plate and the securing plate is secured to a sidewall plate by bolting or welding. FIG. 4(*e*) shows a structure wherein a Y-shaped securing plate is joined to a flange portion of a backstay and the securing plate is secured to a sidewall plate by bolting or welding. FIG. 4(*f*) shows a structure wherein a side pole is made by joining two channel steels to each other so that two flange portions are V-shaped to match a corner portion of a sidewall and the V-shaped flange portion is secured to the sidewall plate on the corner by bolting or welding.

By using the structures described above, a sidewall plate of the furnace sidewall can be easily reinforced and the manpower required with respect to the installation of the furnace sidewall can be reduced. The structures described in FIG. 4(*a*)-(*f*) are not limiting examples of structures which can be used to reinforce the sidewall of the polygonal formed rotary hearth furnace and other structures can be used as long as they serve as members to reinforce the polygonal formed furnace sidewall.

According to the invention, a furnace sidewall structure of a rotary hearth furnace is provided which can reduce manufacturing costs with respect to its furnace sidewall, with ease in controlling and adjusting the accuracy of the manufactured furnace sidewall, shortening the installation work period and reducing the installation cost.

Adopting a flat sidewall panel structure as an element of the inner furnace sidewall and the outer furnace sidewall in the rotary hearth furnace, i.e., adopting a polygonal furnace sidewall profile, makes it possible to skip the process for bending steel sidewall plates/panels and reinforcing members, which brings a reduction in the manufacturing cost of the furnace sidewalls and ease of controlling and adjusting the manufactured product accuracy.

Also the invention provides improvements in the accuracy of the manufactured sidewall plate/panel which can bring a reduction in the work required for adjustment at the installation/construction site, which leads to shortening of the installation/construction work periods and reduction in the cost of installation/construction. Furthermore, lining an inner side of the furnace sidewall with refractory materials along the flat sidewall panels is relatively easy, which leads to a reduction in the setting up process and cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A furnace sidewall structure of a rotary hearth furnace for manufacturing direct reduced iron from compacts, wherein the compacts are a mixture of iron ore or waste iron oxide and carbonaceous material as a reducing agent, wherein the compacts are placed on a rotating hearth and are reduced in a high-temperature atmosphere to thereby produce said reduced iron, or for heating at least one steel piece on the rotating hearth in a high-temperature atmosphere, said furnace sidewall structure comprising:

an outer furnace sidewall, and an inner furnace sidewall, wherein at least one of the outer furnace sidewall or the inner furnace sidewall is polygonal in form, wherein the distance between the outer furnace shell and the inner furnace shell is at least 5 m, and wherein said polygonal furnace sidewall comprises a flat sidewall plate with a burner installed on said flat sidewall plate.

2. The furnace sidewall structure according to claim 1, wherein the outer furnace sidewall is polygonal and the inner furnace sidewall is circular in form.

3. The furnace sidewall structure according to claim 1, wherein the polygonal furnace sidewall includes a flat sidewall plate having an outer sidewall and an inner sidewall, wherein the inner side of said flat sidewall plate is lined by refractory material.

4. The furnace sidewall structure according to claim 2, wherein the polygonal furnace sidewall includes a flat sidewall plate having an outer sidewall and an inner sidewall, wherein the inner side of said flat sidewall plate is lined by refractory material.

5. The furnace sidewall structure according to claim 1, further comprising a backstay of H-section steel having a bent flange in planar contact with adjacent flat sidewall plates in the polygonal furnace sidewall structure.

6. The furnace sidewall structure according to claim 1, further comprising a securing plate in planar contact with at least three adjacent flat sidewall plates in the polygonal furnace sidewall structure, and wherein a flange of a backstay is in planar contact with a flat portion of the securing plate opposite the flat sidewall plates.

7. The furnace sidewall structure according to claim 1, wherein at least two adjacent flat sidewall plates are joined by a bellows comprising a ceramic fiber.

8. The furnace sidewalls structure according to claim 1, wherein edges of adjacent flat sidewall plates are connected to an outer surface of a pipe.

9. The furnace sidewall structure according to claim 1, wherein a Y-shaped securing plate is in planar contact with adjacent flat sidewall plates and is connected to a flange portion of a backstay.

10. The furnace sidewall structure according to claim 1, wherein two separate two channel steels each have a flange portion in planar contact with adjacent flat sidewall plates, wherein said flange portions are V-shaped.

11. The furnace sidewall structure according to claim 1, wherein the polygonal furnace sidewall structure is composed of at least six flat sidewall plates.

12. The furnace sidewall structure according to claim 11, wherein the polygon is composed of 12 to 16 flat side plates.

13. The furnace sidewall structure according to claim 1, wherein the distance between the outer furnace shell and the inner furnace shell is 5-10 m.

14. The furnace sidewall structure according to claim 1, wherein at least one sidewall plate in the outer furnace sidewall and/or inner furnace sidewall is reinforced by at least one reinforcing member secured to the sidewall plate.

15. A method of preparing direct reduced iron agglomerate comprising heating iron ore or waste iron oxide in the presence of a reducing agent, or reducing at least one steel piece on a rotary hearth in a rotary hearth furnace by heating in the furnace sidewall structure as described in claim 1.

16. A method of preparing the furnace sidewall structure for preparing direct reduced iron agglomerate by heating and reducing iron ore or waste iron oxide in the presence of a reducing agent, or for heating at least one steel piece as described in claim 1, comprising a step of securing a lengthwise side of a rectangular or square sidewall plate to a lengthwise side of another sidewall plate, and repeating said securing step to form a polygonal inner and/or outer furnace sidewall.

17. A furnace sidewall structure of a rotary hearth furnace for manufacturing direct reduced iron from compacts, wherein the compacts are a mixture of iron ore or waste iron oxide and carbonaceous material as a reducing agent, wherein the compacts are placed on a rotating hearth and are reduced in a high-temperature atmosphere to thereby produce said reduced iron, or for heating at least one steel piece on the rotating hearth in a high-temperature atmosphere, said furnace sidewall structure comprising:

an outer furnace sidewall, and an inner furnace sidewall, wherein at least one of the outer furnace sidewall or the inner furnace sidewall is polygonal in form, wherein the distance between the outer furnace shell and the inner furnace shell is at least 5 m, wherein said polygonal furnace sidewall comprises a flat sidewall plate with a burner installed on said flat sidewall plate, and wherein the compacts are briquettes or pellets.

18. A furnace sidewall structure of a rotary hearth furnace for manufacturing direct reduced iron from compacts, wherein the compacts are a mixture of iron ore or waste iron oxide and carbonaceous material as a reducing agent, wherein the compacts are placed on a rotating hearth and are reduced in a high-temperature atmosphere to thereby produce said reduced iron, or for heating at least one steel piece on the rotating hearth in a high-temperature atmosphere, said furnace sidewall structure comprising:

an outer furnace sidewall, and an inner furnace sidewall, wherein at least one of the outer surface sidewall or the inner furnace sidewall includes a flat portion therein, wherein the distance between the outer furnace shell and the inner furnace shell is at least 5 m, and wherein said furnace sidewall structure comprises a flat sidewall plate with a burner installed on said flat sidewall plate.

* * * * *